United States Patent [19]

Fahmüller

[11] Patent Number: 4,590,647

[45] Date of Patent: May 27, 1986

[54] DEVICE FOR CLEANING ROTATING ROLLERS OF TEXTILE MACHINES

[75] Inventor: Max Fahmüller, Ingolstadt, Fed. Rep. of Germany

[73] Assignee: Schubert & Salzer, Ingolstadt, Fed. Rep. of Germany

[21] Appl. No.: 656,666

[22] Filed: Oct. 1, 1984

[30] Foreign Application Priority Data

Oct. 5, 1983 [DE] Fed. Rep. of Germany ..... 3336184

[51] Int. Cl.[4] ..... D06B 23/30; D06B 15/02; D01G 15/80

[52] U.S. Cl. ..... 19/262; 19/265

[58] Field of Search ..... 19/262, 264, 265

[56] References Cited

U.S. PATENT DOCUMENTS

| | | | |
|---|---|---|---|
| 2,741,802 | 4/1956 | Preston | 19/265 X |
| 2,858,576 | 11/1958 | Rose | 19/265 X |
| 2,979,783 | 4/1961 | Whitehurst | 19/262 X |
| 3,101,504 | 8/1963 | Gasser | 19/262 X |
| 3,531,832 | 10/1970 | Whitehead et al. | 19/265 |
| 4,171,552 | 10/1979 | Leifeld | 19/262 X |

FOREIGN PATENT DOCUMENTS

| | | | |
|---|---|---|---|
| 1079513 | 4/1960 | Fed. Rep. of Germany | 19/264 |
| 1166669 | 3/1964 | Fed. Rep. of Germany . | |
| 1510318 | 7/1970 | Fed. Rep. of Germany . | |
| 2405018 | 8/1975 | Fed. Rep. of Germany | 19/265 |
| 1438946 | 4/1966 | France | 19/264 |
| 0751964 | 7/1956 | United Kingdom | 19/264 |

*Primary Examiner*—Louis K. Rimrodt
*Attorney, Agent, or Firm*—Dority & Manning

[57] ABSTRACT

In a textile machine, roller cleaning is carried out by means of a stripping knife, the front edge of which is pressed against the surface of the roller in the working position. The stripping knife, while maintaining its contact with the roller, is moved intermittently from this working position into a second working position in which the knife body touches the roller and the front edge of the knife is spaced apart from the roller. Fibers and impurities which have accumulated at the front edge as well as fibers jammed between the front edge and the roller are released as a result and are conveyed away by the roller thereby providing uninterrupted roller cleaning.

8 Claims, 6 Drawing Figures

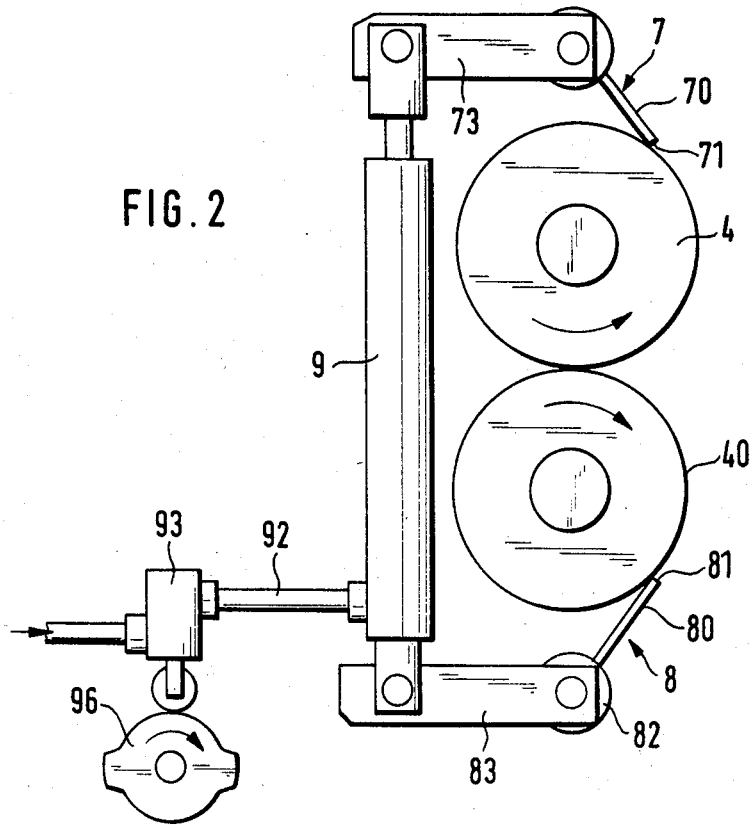
FIG. 2
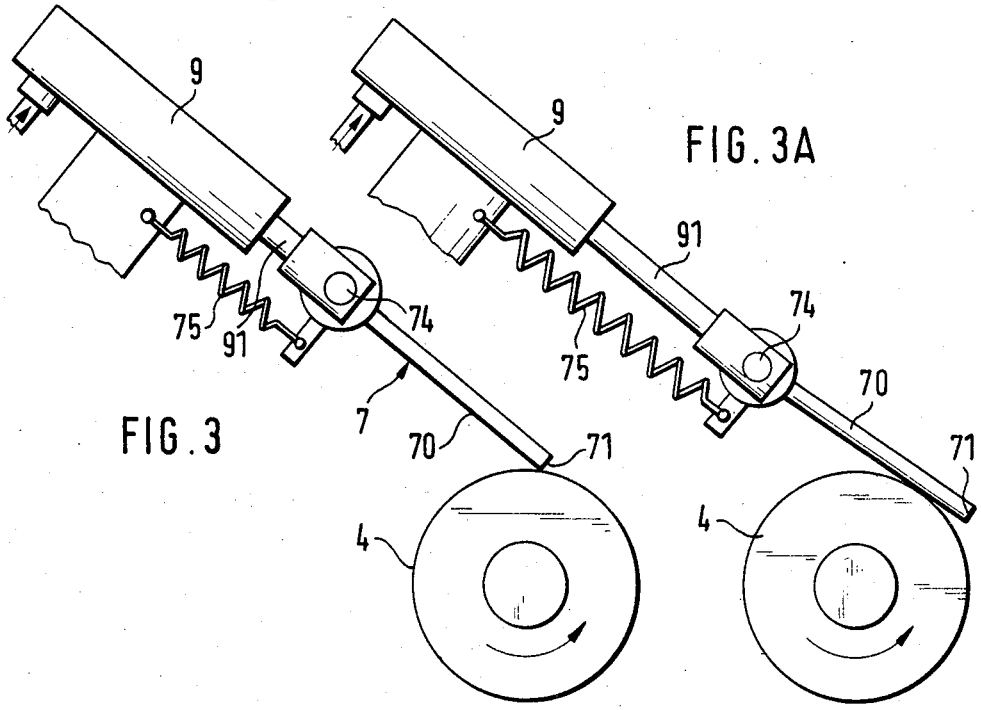
FIG. 3A
FIG. 3

DEVICE FOR CLEANING ROTATING ROLLERS OF TEXTILE MACHINES

FIELD OF THE INVENTION

The invention relates to a device for cleaning rotating rollers of textile machines, especially nipping rollers, with a stripping knife, the front edge of which is pressed against the surface of the roller in the working position and forms a nip line with the latter.

BACKGROUND OF THE INVENTION

To ensure a faultless passage of a nonwoven material or sliver through the nip line of a pair of rotating rollers, adhering fibers and impurities must constantly be cleared from the surface of the rollers. This also applies, in particular, to nipping rollers on carding machines or drawing frames, to which vegetable impurities contained to an increased extent in the nonwoven material and crushed by the rollers, as well as fibers, remain stuck.

For the cleaning of rollers with an essentially smooth surface, such as nipping rollers and drawing-frame rollers, it is known to use stationary stripping knives or strippers, the front edge of which is pressed against the roller surface (German Offenlegungsschrift No. 1,510,318 and German Patent Specification No. 1,166,669). However, during the cleaning of the rollers, impurities and fibers stripped from the roller settle on the front edge of the knife and have to be removed from time to time. It is important, above all, to ensure that fiber material jammed between the roller and the stripping knife is removed since these jammed fibers impair the cleaning effect of the stripping knife and, when accumulated in relatively large amounts, can render the stripping knife completely inoperative.

The disadvantage of manual elimination of the jammed fiber material, in which the stripping knife is lifted off from the roller, is that the roller remains uncleaned during this time, and consequently, a break in the nonwoven material can be caused. The machine then has to be stopped, thus resulting in a loss of production. A production loss also occurs when the machine is stopped from the outset for reasons of safety.

It has already been proposed, therefore, that the material deposited in front of and on the stripping knife be removed by means of a tab fastened to a rotating cylinder and be thrown in the direction of a suction element (German Offenlegungsschrift No. 1,510,318). In this case, as a result of the jerky movement of the tab, even fibers jammed between the stripping knife and the roller will be released or torn. Although this known device makes it possible to leave the stripping knife in its working position so that the cleaning of the roller is not interrupted, nevertheless, its cleaning effect is unsatisfactory in terms of the removal of jammed fibers, since predominantly only portions of these fibers are torn off and the remaining fiber residues remain jammed.

The object of the present invention is to remove reliably and in a simply way the fiber accumulations impairing the effectiveness of the stripping knife, without interrupting the cleaning of the roller, and thereby guarantee that the stripping knife remains operable.

SUMMARY OF THE INVENTION

In a device according to one embodiment of this invention, such object is achieved by movement of the stripping knife, while maintaining its contact, into a second working position in which the knife body touches the roller and the front edge is spaced apart from the roller.

Advantageous developments of the invention are further described in the following disclosure.

DESCRIPTION OF THE DRAWINGS

The construction designed to carry out the invention will be hereinafter described, together with other features thereof.

The invention will be more readily understood from a reading of the following specification and by reference to the accompanying drawing(s) forming a part thereof, wherein an example of the invention is shown and wherein:

FIG. 2 shows the nipping rollers of FIG. 1 with stripping knives in the known working position;

FIGS. 3 and 3*a* show a second embodiment of the movement of the stripping knife into the second working position.

DESCRIPTION OF THE PREFERRED EMBODIMENT

Figure 1:
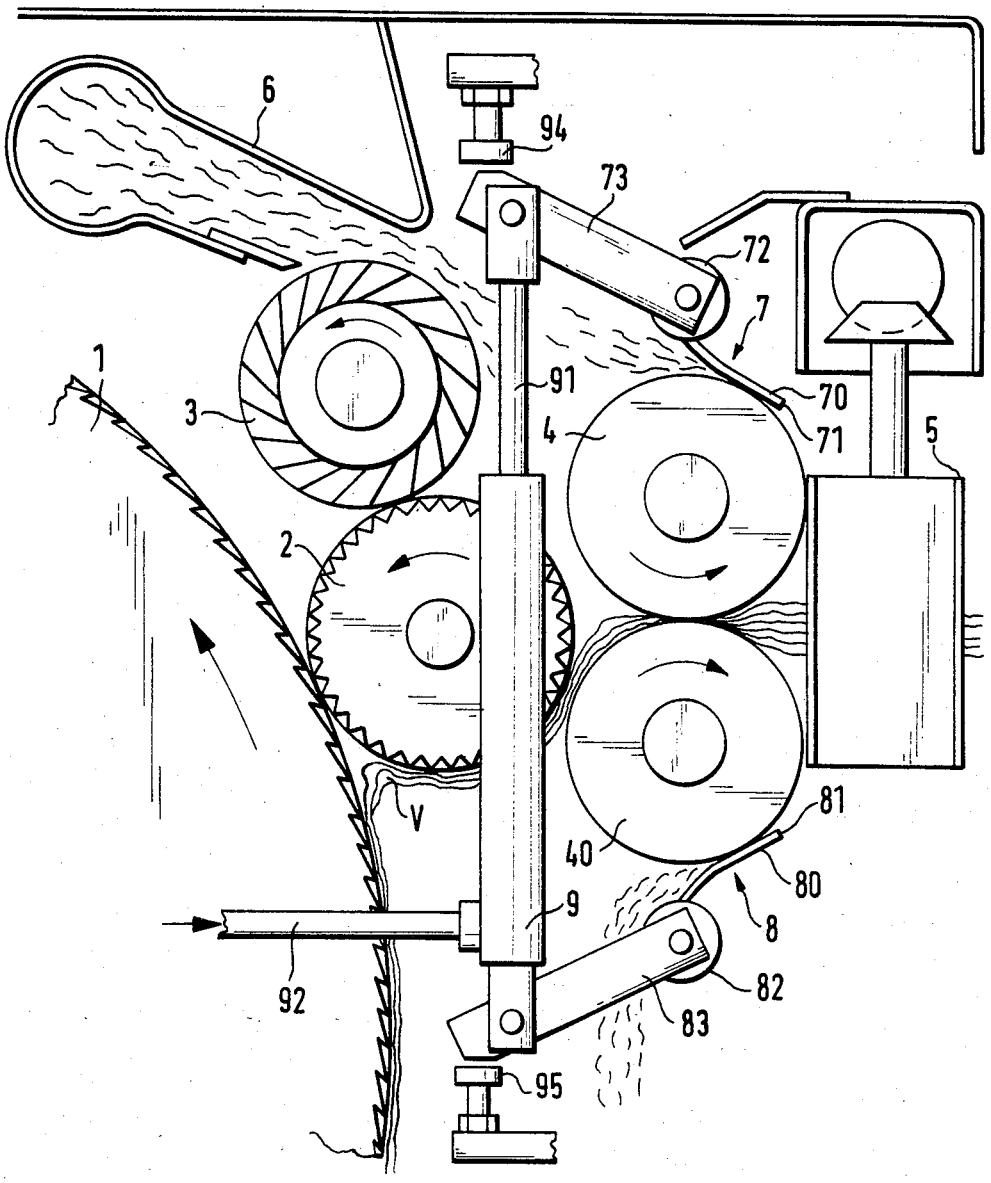
FIG. 1 shows the delivery part of a carding machine with a pair of nipping rollers and with stripping knives moved into the second working position.

In FIG. 1, 1 denotes a doffer, from the covering of which a nonwoven material V is doffed by means of a doffing roller 2. The doffing roller 2, to which a clearing roller 3 is assigned, is followed by a pair of nipping rollers 4 and 40, between which impurities, for example leaf and husk parts, contained in the nonwoven material V are crushed under high pressure. The nonwoven material V emerging from the nipping rollers 4 and 40 is combined into a sliver, in the exemplary embodiment by means of conveyor belts 5 touching the nipping rollers and running in opposition to one another.

Fiber material picked up by the clearing roller 3 is sucked through a suction line 6 which opens about the clearing roller.

A stripping knife 7, 8 is assigned to each of the two nipping rollers 4 and 40. The respecitve knife bodies 70 or 80 terminate in sharp edges 71 or 81 which, in the customary working position shown in FIG. 2, rest against the roller surface at a specific angle of incidence favorable for the cleaning of the rollers. This working position is designated below as the first working position. The stripping knives 7 and 8 are fastened to supports 72 and 82 mounted rotatably in the machine frame and consist completely or only partially of spring band steel which is prestressed so that their front edge 71 or 81, respectively, is pressed against the nipping rollers 4 and 40 with a predetermined pressure and a nip line is formed. A lever 73 and 83 is fastened at one or both ends of each of the supports 72 and 82. The lever 73 is connected to the piston rod 91 of a compressed-air cylinder 9, while the lever 83 is connected to the housing of the compressed-air cylinder 9. A compressed-air line 92 with a valve 93, which can be a two-way or three-way valve, connects the compressed-air cylinder 9 to a compressed-air device (not shown).

In continuous operation, the stripping knives 7 and 8 are initially located in their first working position (FIG. 2) in which their front edge 71 and 81 pressed against the nipping rollers 4 and 40 scrapes fibers and impurities off the roller surface. At intervals, the stripping knives 7 and 8 are brought from this position into the second working position shown in FIG. 1, in which the knife bodies 70 and 80 touch the nipping rollers 4 and 40 and the front edges 71 and 81 are spaced apart from the roller body.

The valve 93 is actuated for this purpose, so that compressed air flows into the compressed-air cylinder 9 and pushes the piston rod 91 upwards while the compressed air cylinder 9 moves downwards as a result of the counter pressure. Because of this, a pressure directed towards the nipping rollers 4 and 40 is exerted on the stripping knife 7 via the lever 73 and on the stripping knife 8 via the lever 83 and moves the stripping knives towards the nipping rollers. With continuing pressure, the knife bodies 70 and 80 first come tangentially up against the nipping rollers 4 and 40 and then move along the roller surface, in the end position the front edges 71 and 81 coming free of the rollers, as shown in FIG. 1. During the transition from the first working position to the second, the stripping knife thus remains constantly in contact with the roller, so that the cleaning of the latter is not interrupted and in the second working position is taken over by the knife body.

The end position of the stripping knives 7 and 8 in the second working position and consequently the distance between the front edges 70 and 80 and the nipping rollers 4 and 40 can be limited by adjustable stops 94 and 95 which are located in the pivoting range of the levers 73 and 83 (FIG. 1). It is sufficient, in general, to fix the end position of the stripping knives 7 and 8 so that the front edges 71 and 81 of the stripping knives 7 and 8 are at a distance of a fraction of a millimeter from the roller.

As a result of the movement of the front edge of the stripping knife away from the roller, the fibers jammed between the front edge and the roller are released and carried along by the rotating roller, as are fibers and impurities which have accumulated at the front edge of the stripping knife in its first working position and which are now drawn into the gap existing between this front edge and the roller and conveyed away. At the same time, the frictional forces prevailing between the knife body and the roller assist the capacity of the roller to carry along the fibers and the impurities. After it has passed the nip point formed by the knife body, the material carried along by the nipping rollers is thrown from the nipping roller 4 in the direction of the suction line 6 and from the nipping roller 40 into the lower card space.

To subject the stripping knives 7 and 8 to the self-cleaning described, it is sufficient to leave the stripping knives in the second working position for a short time only. The stripping knives 7 and 8 are then moved into their first working position again.

The actuation of the valve 93 for feeding the compressed air into the compressed air cylinder 9 and for removing it, in order to move the stripping knives from one working position to the other, can be carried out manually and a periodically. However, a periodic change in the working positions is preferably made at predetermined intervals this being effected, for example, by means of a cam disk 96 actuating the valve 93 (FIG. 2).

Figure 4:
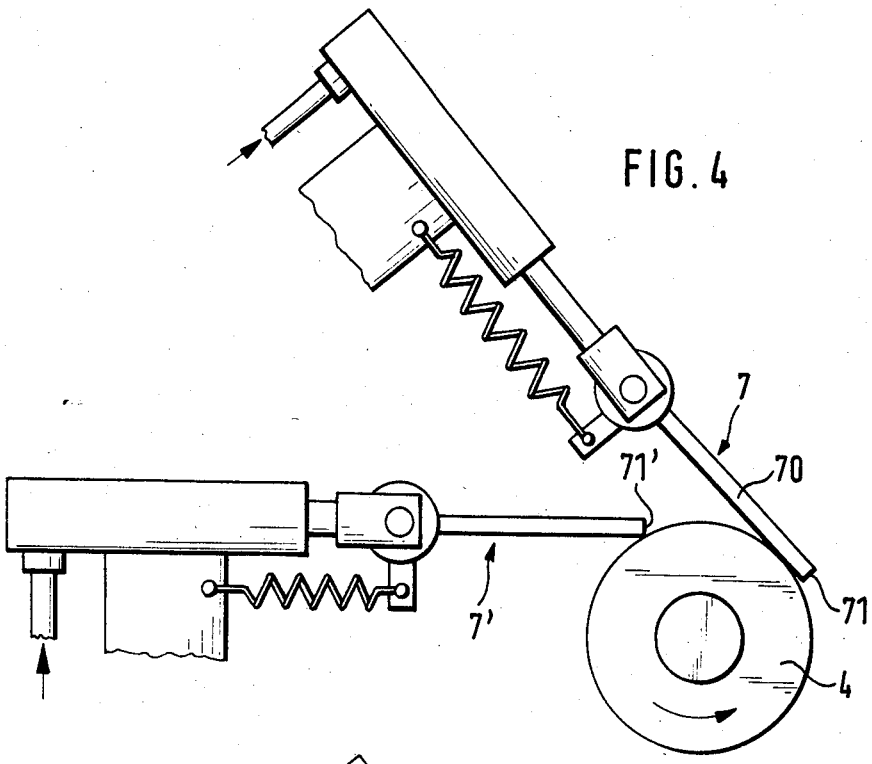
FIGS. 4 and 4*a* show a roller with two stripping knives which are moved alternately into the second working position.
Figure 4A:
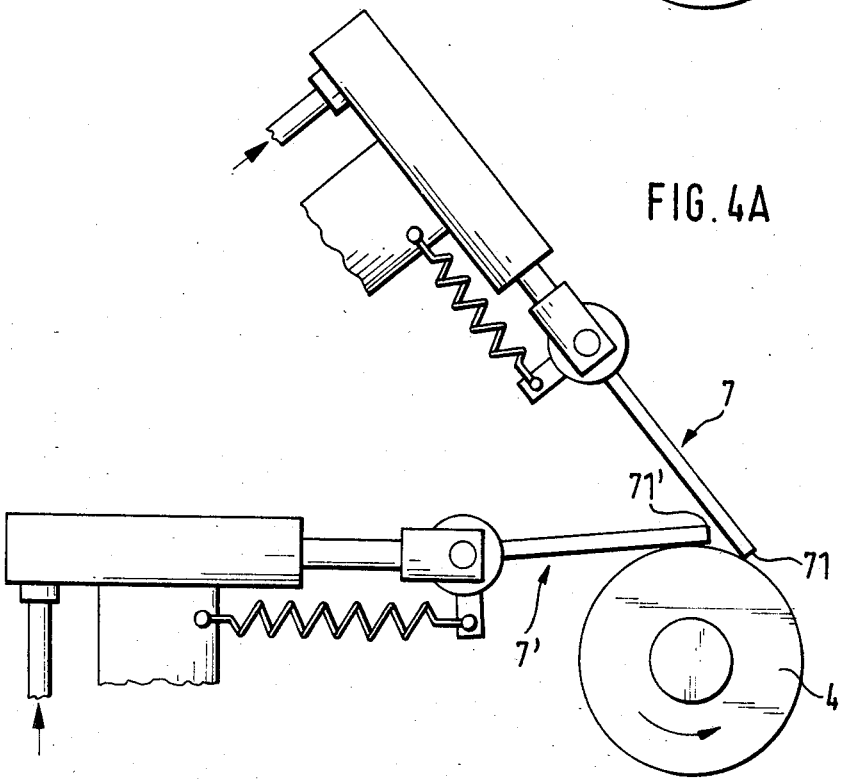

In contrast to the exemplary embodiment according to FIGS. 1 and 2, in which the stripping knives are moved into the second working position by means of a pressure force directed towards the roller, in the device illustrated in FIGS. 3 and 3*a*, the stripping knife 7 is displaced, while maintaining its contact with the nipping roller 4, from the first working position into the second in a straight line. A fixed compressed-air cylinder 9 is used a displacement means. The stripping knife 7 is mounted on the piston rod 91 of the compressed-air cylinder 9 and is pivotable about a journal 74. A spring 75 presses the stripping knife 7 against the surface and impurities released by the front edge 71' are initially carried along by the nipping roller 4 up to the front edge 71 of the stripping knife 7 (FIG. 4*a*) and, when the stripping knives 7 and 7' have arrived at the position according to FIG. 4 again, are thrown towards the suction line. This operation is repeated, preferably periodically, and the intervals at which the two stripping knives 7 and 7' are moved alternately into the second working position, and the time during which they remain in this position, can be fixed as a result of appropriate adjustment of the cam disk 96 actuating the valves (FIG. 2) or by means of another device known for this purpose.

The invention is not restricted to the exemplary embodiments described. Thus, for example, any other suitable device can be used for the movement of the stripping knife, instead of a compressed-air cylinder, or the mechanical movement can also be replaced by a manual movement. The invention can likewise also be used advantageously on other essentially smooth rollers.

It will be understood, of course, that while the form of the invention herein shown and described constitutes a preferred embodiment of the invention, it is not intended to illustrate all possible forms of the invention. It will also be understood that the words used are words of description rather than of limitation and tha various changes may be made without departing from the spirit and scope of the invention herein disclosed.

What I claimed is:

1. A device for cleaning rotating rollers of textile machines comprising:

(a) a stripping knife, the front edge of which is pressed against the surface of the roller in a first working position; and (b) means for moving the stripping knife while maintaining its contact with the roller into a second working position in which the knife body touches the roller and the front edge of the knife is spaced apart from the roller.

2. A device as claimed in claim 1 including means for moving the stripping knife periodically into the second working position.

3. A device as claimed in claim 1 wherein said means for moving the stripping knife into the second working position directs a pressure force towards the roller.

4. A device as claimed in claim 3 wherein said means for moving the stripping knife includes a knife support; a lever fastened to the knife support; a compressed-air cylinder connected to the lever whereby the pressure force is generated by the action of said cylinder.

5. A device as claimed in claim 4 wherein the means for moving the stripping knife includes adjustable stops for limiting the end position of the stripping knife in the second working position.

6. A device as claimed in claim 1, including means for displacing the stripping knife along the roller surface into the second working position.

7. A device as claimed in claim 1 including a second stripping knife and means for moving the second knife into first and second working positions, the movement of the first knife into its second working position alternating with the movement of the second knife into its second working position.

8. A self-cleaning apparatus for continuously cleaning a rotating roller of a textile machine, comprising:

a stripping knife, having a knife body and a knife edge, adapted for use in association with said roller for contact cleaning same; and displacement means for selectively disposing said knife in a first position defined by only said edge of said knife contacting said roller, and in a second position defined by only said body of said knife contacting said roller, wherein said knife remains in continuous contact with said roller whenever said displacement means moves said knife between said first and second positions.

* * * * *